US005723180A

United States Patent [19]

Boulanger

[11] Patent Number: 5,723,180

[45] Date of Patent: Mar. 3, 1998

[54] METHOD FOR APPLYING A COATING CORROSION RESISTANT MATERIAL TO A VEHICLE FRAME STRUCTURE

[75] Inventor: Peter D. Boulanger, West Lawn, Pa.

[73] Assignee: Dana Corporation, Toledo, Ohio

[21] Appl. No.: 773,939

[22] Filed: Dec. 30, 1996

[51] Int. Cl.[6] ..... B05D 1/02; B05D 1/18; B05D 1/32

[52] U.S. Cl. ..... 427/271; 427/272; 427/282; 427/421; 427/422; 427/435; 427/443; 427/409

[58] Field of Search ..... 427/271, 272, 427/277, 282, 409, 422, 435, 443, 421

[56] References Cited

U.S. PATENT DOCUMENTS

| | | | |
|---|---|---|---|
| 3,900,593 | 8/1975 | Herczog et al. | 427/53 |
| 4,130,524 | 12/1978 | Boerwinkle et al. | 260/29.6 HN |
| 4,150,192 | 4/1979 | Downey . | |
| 4,546,015 | 10/1985 | Lovell | 427/247 |
| 4,842,903 | 6/1989 | Hayner . | |
| 4,891,073 | 1/1990 | Shortt et al. | 134/20 |
| 5,020,472 | 6/1991 | Kiba et al. | 118/668 |
| 5,106,415 | 4/1992 | Davidian . | |
| 5,262,241 | 11/1993 | Huggins | 428/421 |
| 5,385,655 | 1/1995 | Brent et al. | 204/181.1 |
| 5,540,880 | 7/1996 | Horiki et al. | 264/553 |
| 5,648,158 | 7/1997 | Pfeffer | 428/325 |

*Primary Examiner*—Michael Lusignan
*Assistant Examiner*—Michael Barr
*Attorney, Agent, or Firm*—MacMillan, Sobanski & Todd

[57] ABSTRACT

A method for applying a coating of a corrosion resistant material to an individual vehicle frame component or to an assembled vehicle frame structure includes the initial step of heating the vehicle frame component to a predetermined temperature, such as by passing it through a furnace. Then, a coating of a first corrosion resistant material, such as wax, is applied to the vehicle frame. Preferably, the coating of the first wax is applied to the vehicle frame structure by dipping it in a hot bath of the first wax material. The vehicle frame structure is then removed from the bath, and heat is maintained thereon to allow excess first wax to drip off. A coating of a second corrosion resistant material, such as wax, is then applied at localized areas of the vehicle frame structure in place of the first wax coating. The first wax can be removed by any suitable method, such as by scraping, dissolving, or masking the localized area of the vehicle frame structure. Preferably, however, the second corrosion resistant material is applied by spraying it at a sufficient velocity and temperature so that the first wax coating is simultaneously removed and replaced by the second wax coating. After the second wax has been applied to the localized areas of the vehicle frame structure, the frame is cooled to harden the coatings of the first and second waxes.

20 Claims, 5 Drawing Sheets

METHOD FOR APPLYING A COATING CORROSION RESISTANT MATERIAL TO A VEHICLE FRAME STRUCTURE

BACKGROUND OF THE INVENTION

This invention relates in general to the manufacture of vehicle frame structures. More specifically, this invention relates to a method for applying a coating of a corrosion resistant material to an individual vehicle frame component or an assembled vehicle frame structure.

Virtually all land vehicles in common use, such as automobiles and trucks, include a frame which serves as a platform upon which the remainder of the vehicle is built. Many vehicle frame structures are known in the art. Most of these known vehicle frame structures are formed from a number of individual metallic components which are permanently joined together. For example, one type of vehicle frame structure is known as a full perimeter frame assembly. A typical full perimeter frame assembly is composed of a pair of longitudinally extending side rails which are joined together at the front by a forward cross member, at the rear by a rearward cross member, and at intermediate locations by one or more intermediate or auxiliary cross members. The cross members not only connect the two side rails together, but also provide desirable lateral and torsional rigidity to the vehicle frame assembly. The full perimeter frame assembly functions as a platform upon which the body and remaining components of the vehicle are supported.

The individual vehicle frame components of the vehicle frame structure are typically formed from metallic materials, such as steel, which are naturally susceptible to corrosion. Furthermore, during operation of the vehicle, such vehicle frame components are frequently exposed to environmental conditions which promote the occurrence and accelerate the rate of corrosion, including moisture (from rain, snow, and humidity), heat, and corrosive chemicals (such as salt used for melting snow and ice). Obviously, the corrosion of any vehicle frame component is undesirable and can lead to premature failure of the vehicle frame structure as a whole. To resist the occurrence and rate of corrosion, it is known to apply a coating of a corrosion resistant material to some or all of the surface of the vehicle frame structure during manufacture. This corrosion resistant coating covers the outer surface of the vehicle frame structure so as to shield it from some of the adverse environmental conditions mentioned above, thereby resisting the corrosion process.

Conventional hot melt wax compositions represent one known family of coating materials which are commonly applied to some or all of the vehicle frame structure during manufacture. To apply a hot melt wax coating, the vehicle frame structure is first heated to a predetermined temperature, typically by passing it through a large furnace or other heated area. The hot melt wax is disposed within a container and heated to a sufficient temperature as to cause it to melt into a liquid bath. The heated vehicle frame structure is then dipped into the bath of molten hot melt wax so as to completely cover all of the exposed metallic material. The vehicle frame structure is then removed from the bath of molten hot melt wax and, for a short time thereafter, maintained at a relatively high temperature to allow excess wax to drip off. Finally, the vehicle frame structure is cooled, causing the molten hot melt wax to harden on the surface of the vehicle frame structure.

Although this coating process has functioned satisfactorily in the past, it has been found that some components of some modern vehicles generate relatively large amounts of heat in localized areas which are adjacent to portions of the vehicle frame structure. For example, localized areas of increased heat can be generated by the engine and exhaust system of the vehicle. In those instances where a localized area of increased heat is generated adjacent to a portion of the vehicle frame structure which has been coated by a conventional hot melt wax composition, it has been found that the hardened wax coating can melt and drip off of that area of the vehicle frame structure. This melting and dripping is obviously undesirable because it removes the protective coating from that portion of the vehicle frame structure, exposing it to the corrosive environmental conditions discussed above. Also, the melting and dripping of the hardened wax coating may be misinterpreted as an oil leak or other problem with the vehicle. One possible solution would be to provide a hot melt wax composition which has a melting temperature which is higher than the temperatures normally generated in these localized areas. Unfortunately, because the temperatures encountered in the localized areas of increased heat as so high, such alternative hot melt wax compositions are relatively expensive and difficult to apply. Thus, it would be desirable to provide an improved method for applying a coating of a corrosion resistant material to an individual vehicle frame component or an assembled vehicle frame structure.

SUMMARY OF THE INVENTION

This invention relates to an improved method for applying a coating of a corrosion resistant material to an individual vehicle frame component or to an assembled vehicle frame structure. Initially, the vehicle frame component is heated to a predetermined temperature, such as by passing it through a furnace or other heated area. Then, a coating of a first corrosion resistant material, such as a first wax having a relatively low melting temperature, is applied to the vehicle frame. Preferably, the coating of the first wax is applied to the vehicle frame structure by dipping it in a hot bath of the first wax material. The vehicle frame structure is then removed from the bath, and heat is maintained thereon to allow excess first wax to drip off. A coating of a second corrosion resistant material, such as a second wax having a relatively high melting temperature, is then applied at localized areas of the vehicle frame structure in place of the first wax coating. The first wax can be removed by any suitable method, such as by scraping, dissolving, or masking the localized area of the vehicle frame structure. Preferably, however, the second corrosion resistant material is applied by spraying it at a sufficient velocity and temperature so that the first wax coating is simultaneously removed and replaced by the second wax coating. After the second wax has been applied to the localized areas of the vehicle frame structure, the frame is cooled to harden the coatings of the first and second waxes.

Various objects and advantages of this invention will become apparent to those skilled in the art from the following detailed description of the preferred embodiments, when read in light of the accompanying drawings

Figure 2:
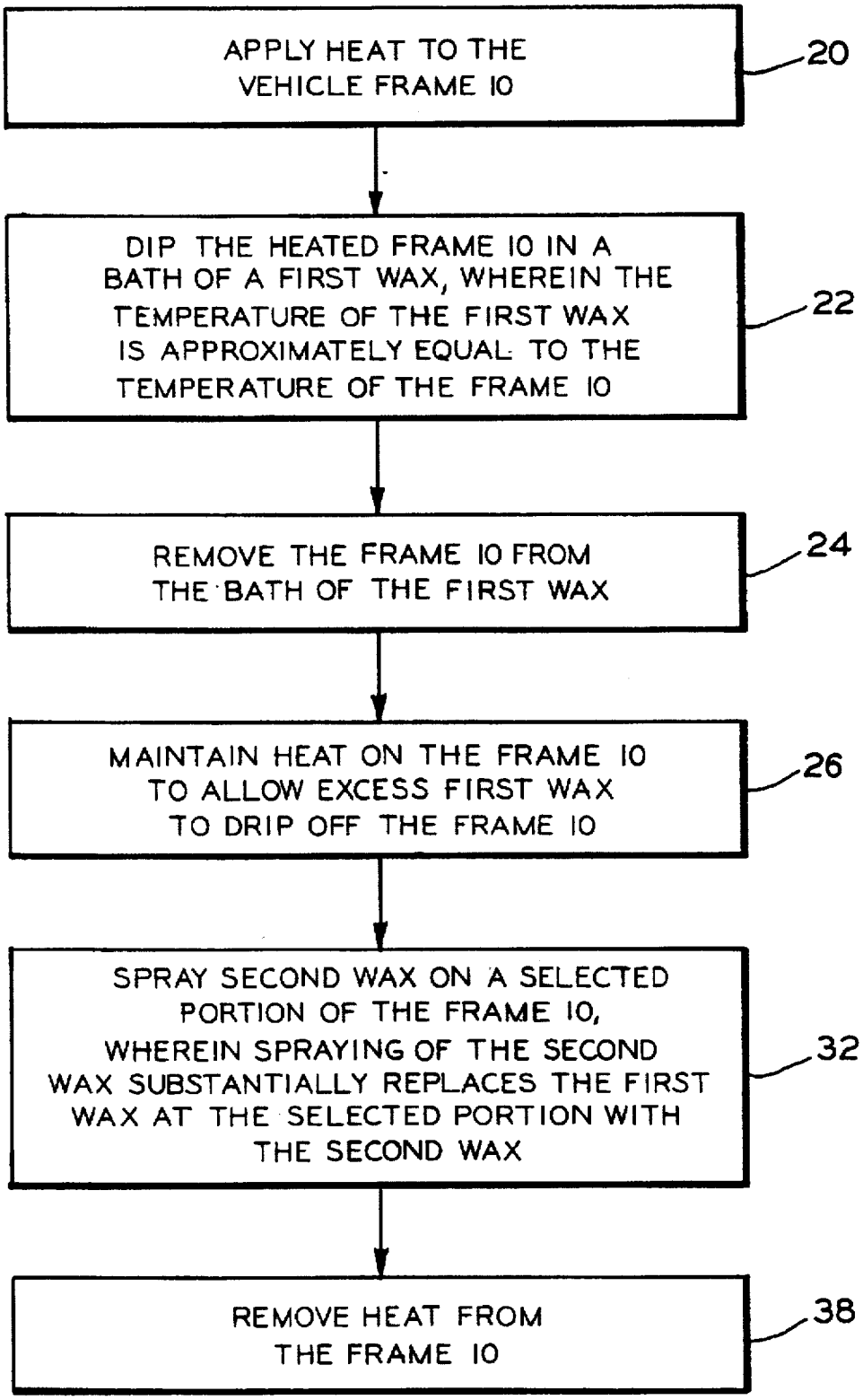
FIG. 2 is a flow diagram of a first method of this invention for applying a coating of a corrosion resistant material to the vehicle frame structure illustrated in FIG. 1.

1 showing several steps in the first method of this invention illustrated in FIG. 2.

Figure 1:
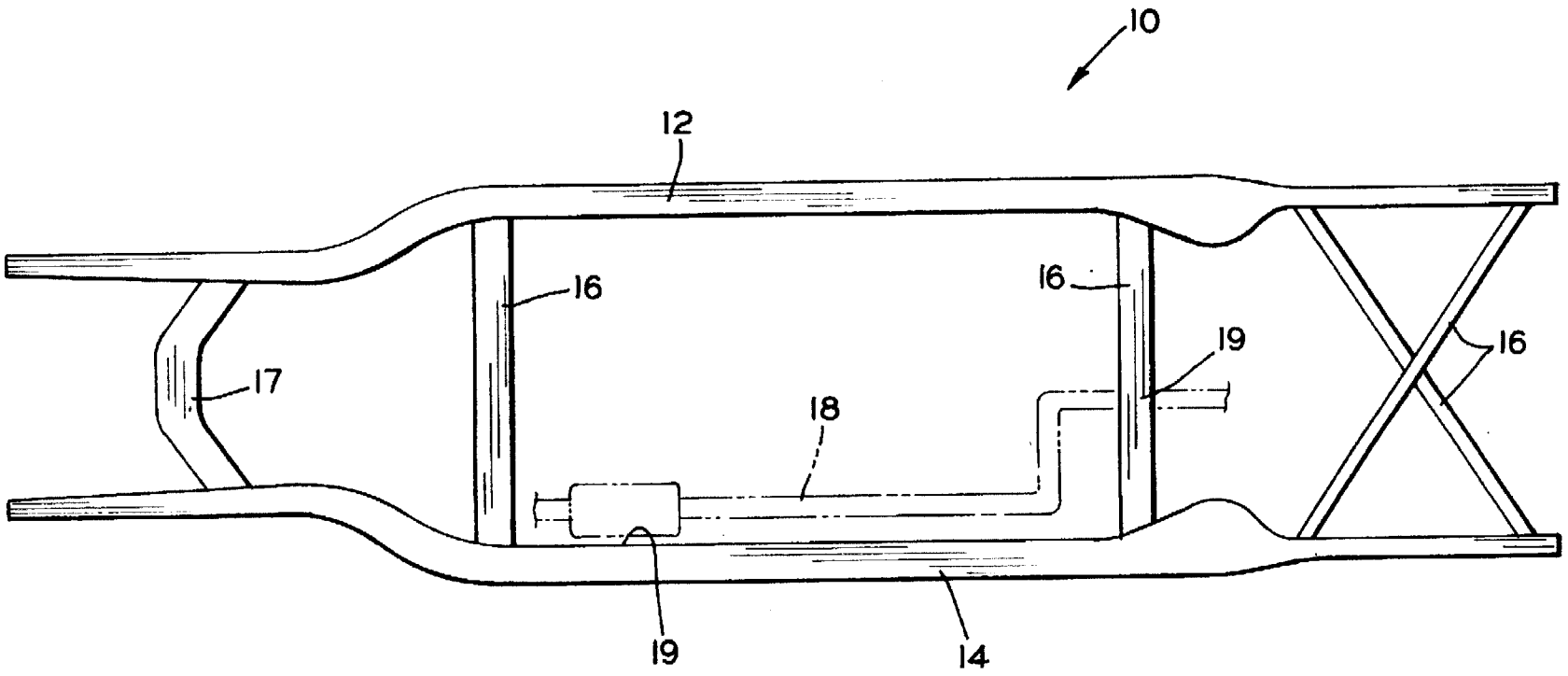
FIG. 1 is a top plan view of a vehicle frame structure adapted to be provided with a coating of a corrosion resistant material in accordance with the method of this invention.
Figure 6:
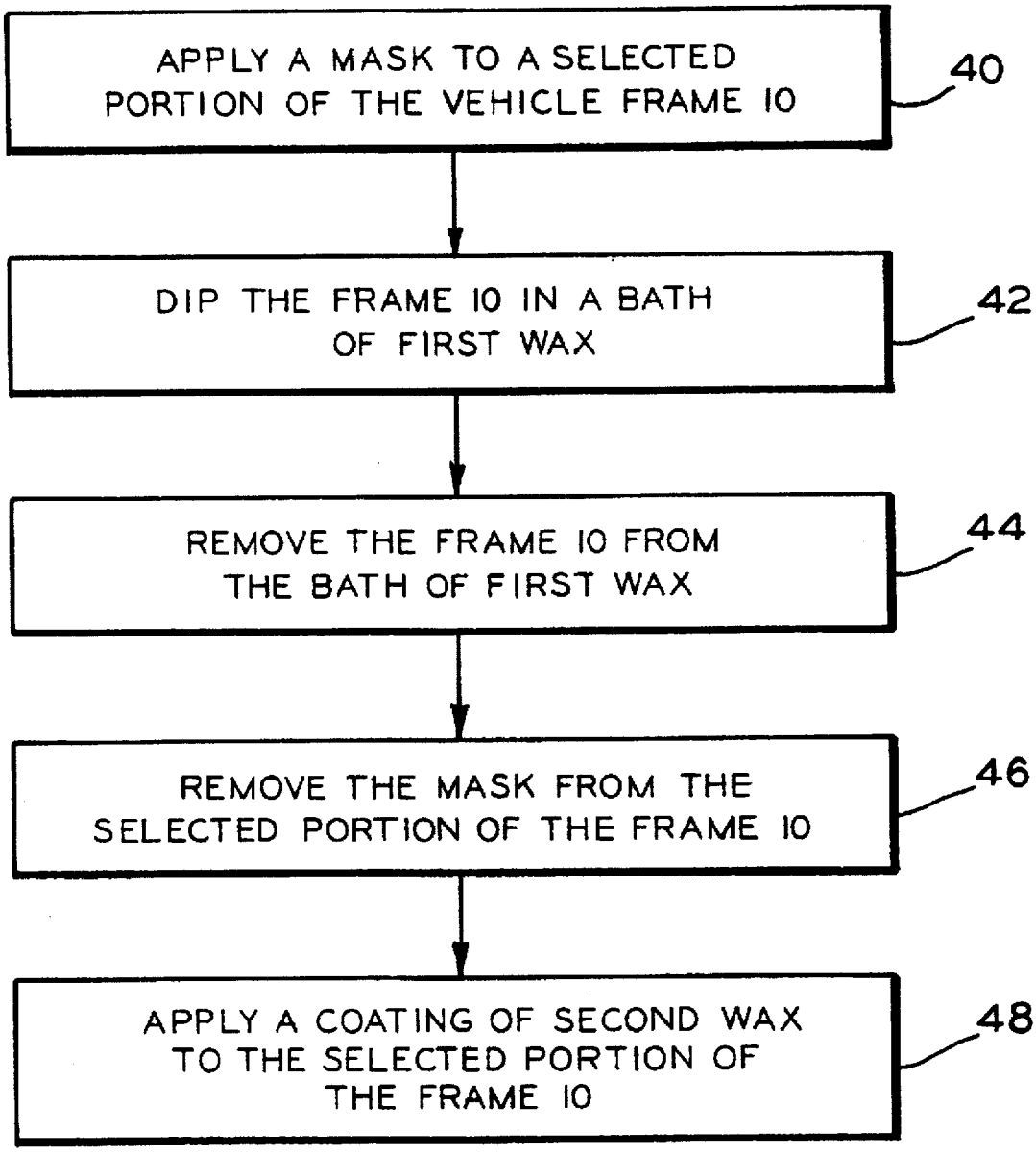

FIG. 6 is a flow diagram of a second method of this invention for applying a coating of a corrosion resistant material to the vehicle frame structure illustrated in FIG. 1.

Figure 7:
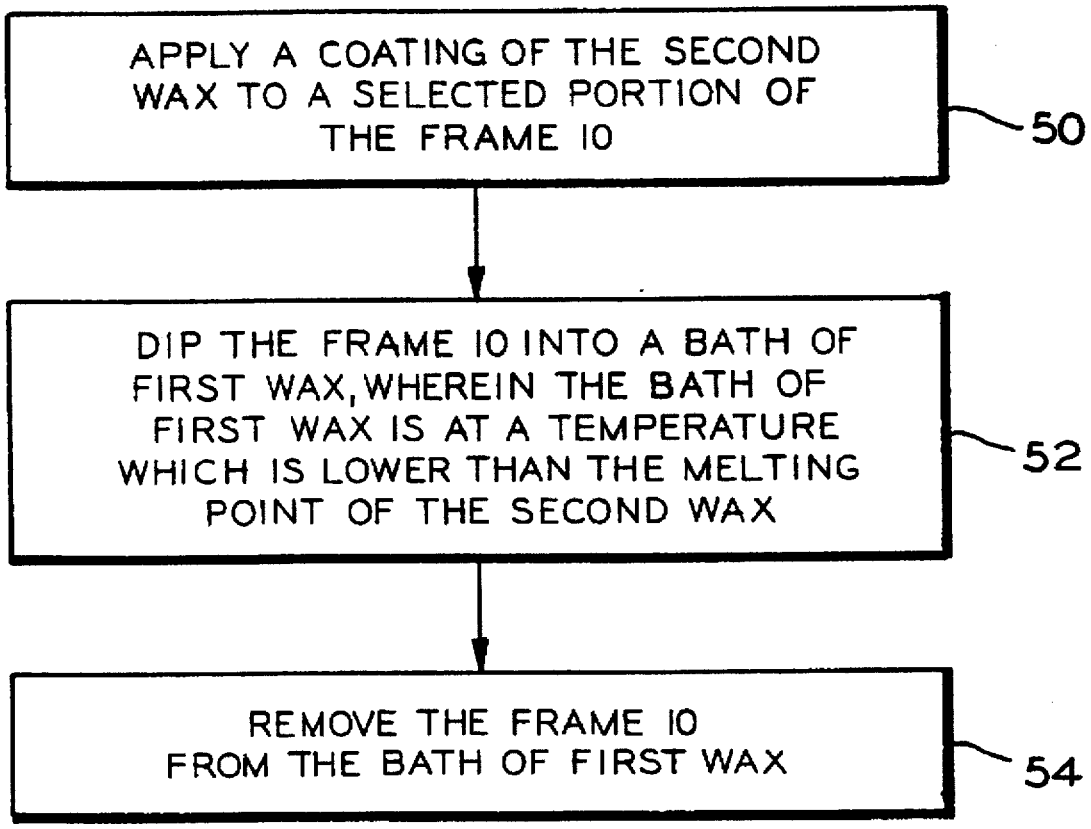

FIG. 7 is a flow diagram of a third method of this invention for applying a coating of a corrosion resistant material to the vehicle frame structure illustrated in FIG. 1.

DETAILED DESCRIPTION OF THE PREFERRED EMBODIMENTS

Referring now to the drawings, there is illustrated in FIG. 1 a vehicle frame structure, indicated generally at 10, which is generally conventional in the art. The vehicle frame structure 10 includes a pair of longitudinally extending side rails 12 and 14 which may, but not necessarily, extend the entire length of the vehicle. The side rails 12 and 14 are joined together by a plurality of transversely extending cross members 16. The cross members 16 can be secured to the side rails 12 and 14 in any suitable manner, such as by welding. Also, vehicle frame structure 10 may include an engine cradle 17 which joins the front portions of the side rails 12 and 14 together. The engine cradle 17 is shaped so as to support an engine (not shown) of the vehicle thereon. The illustrated vehicle frame structure 10 is intended to be representative of any conventional vehicle frame structure which can be used in conjunction with the method of this invention.

A portion of the exhaust system of the vehicle is shown at 18 in FIG. 1. The illustrated exhaust system 18 is intended to be representative of any source of relatively high heat within the vehicle. For example, similar localized areas of increased heat (not shown) may occur elsewhere on the vehicle frame structure 10, such as adjacent to portions of the engine and other components mounted on the vehicle. As shown in FIG. 1, portions of the exhaust system 18 are located adjacent to portions of the vehicle frame structure 10, resulting in localized areas 19 of increased heat on the vehicle frame structure 10. In the illustrated embodiment, localized areas 19 of increased heat are generated on the side rail 14 and one of the cross members 16. However, these localized areas 19 may occur at any location on the vehicle frame structure 10.

FIG. 2 is a flow diagram which illustrates a first method of applying a coating of a corrosion resistant material to the vehicle frame structure 10 in accordance with this invention. Initially, the vehicle frame structure 10 is heated to a predetermined temperature, as indicated at step 20 in FIG. 2. The vehicle frame structure 10 can be heated by any conventional method, such as by passing the vehicle frame structure 10 through an industrial furnace or other heated area. As will be described below, the vehicle frame structure 10 remains heated at a relatively high temperature throughout most of the coating process. Therefore, it has been found desirable to suspend the vehicle frame structure 10 from a monorail or other movement mechanism which can carry the vehicle frame structure 10 through the furnace and on to other work stations.

Once the vehicle frame structure 10 is heated to the desired temperature, a coating of a first corrosion resistant material is applied thereto, as indicated at step 22 in FIG. 2. The first corrosion resistant material can be any suitable material which has sufficient corrosion resistant properties. Preferably, the first corrosion resistant material is a wax material having a relatively low melting temperature, such 895200 wax material which is commercially available trader the designation "THIEM MELT" from Henkel Corp., Parker Amchen-Thiem Division, of Oak Creek, Wis. For the sake of brevity, the first corrosion resistant material will be referred to as the first wax. The coating of the first wax can be applied to the entire surface area of the vehicle frame structure 10, or may be applied only to selected portions thereof. In either event, the first wax can be applied to the vehicle frame structure 10 by any known means, such as by spraying or dipping. Preferably, the first wax is applied to the vehicle frame structure 10 by dipping it into a hot molten bath of the first wax which has been heated to approximately the same temperature as that of the vehicle frame structure 10. The pre-heating of the vehicle frame structure 10 is desirable to prevent non-uniform solidification of the molten first wax when it initially contacts the vehicle frame structure 10. It has been found that a suitable temperature for the vehicle frame structure 10 and the first wax is within the range of from about 245° F. to about 310° F. (121° C. to about 154° C.). Of course, the desired temperature range will be dependent on the specific type of wax used and its melting point properties. By dipping the vehicle frame structure 10 into the hot molten bath of wax, the entire surface area thereof can be evenly coated in a relatively short period of time. Conventional vehicle frames, such as the vehicle frame structure 10, may have various structural recesses and openings which form areas which would be otherwise be difficult to reach with other methods of applying wax coatings, such as by spraying. Therefore, dipping is the preferred method of applying the coat of first wax.

Figure 3:
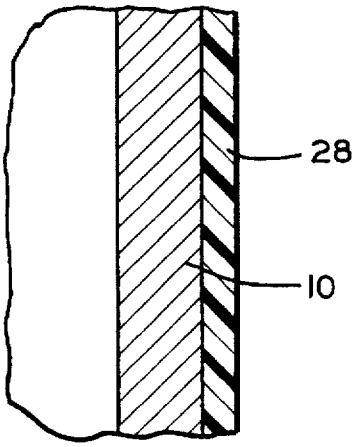
FIGS. 3, 4, and 5 are enlarged sectional elevational views of a portion of the vehicle frame structure illustrated in FIG.

After the being dipped and coated with the first wax, the vehicle frame structure 10 is removed from the bath of the first wax, as indicated by step 24 in FIG. 2. Preferably, the temperature of the vehicle frame structure 10 is maintained at or near the relatively high temperature by continuing to heat it, as indicated by step 26 in FIG. 2. This step is performed so that excess first wax material will drip off of the vehicle frame structure 10. This step in the process may, for example, be performed at a different location within the furnace. For example, when the "THIEM MELT" 895200 wax material is used, it has been found to be desirable to maintain the temperature of the vehicle frame structure 10 within the range of from about 220° F. to about 240° F. (104° C. to about 116° C.). After a sufficient time has passed, most of the excess first wax material will drip off of the vehicle frame structure 10, leaving a coating 28 (see FIG. 3) of the first wax material having a relatively uniform thickness on the outer surface of the vehicle frame structure 10.

Referring back to FIG. 2, the next step in the first method of this invention is to replace localized portions of the first corrosion resistant material with a second corrosion resistant material, as shown at step 32. The second corrosion resistant material should preferably have a higher melting temperature, and thus be capable of withstanding higher temperatures without melting, than the first corrosion resistant material. Thus, the second corrosion resistant material can also be any suitable material which has sufficient corrosion resistant properties, but which preferably has a higher melting temperature than the first corrosion resistant material. Preferably, the second corrosion resistant material is a also wax material, such 1120 wax material which is commercially available from Daubert Chemical of Chicago, Ill. For the sake of brevity, the second corrosion resistant material will be referred to as the second wax.

Figure 4:
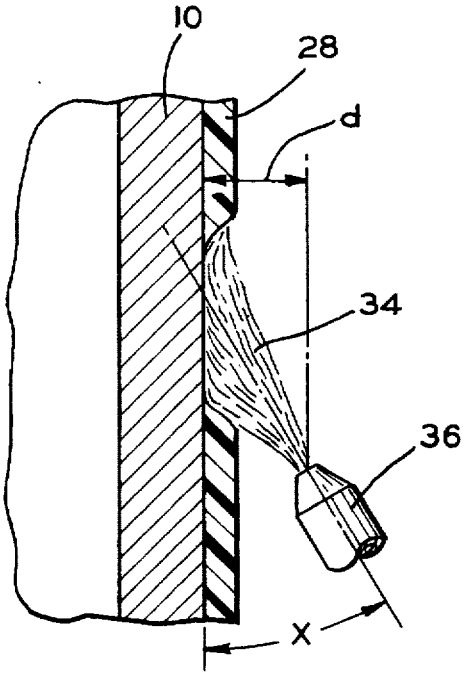
Figure 5:
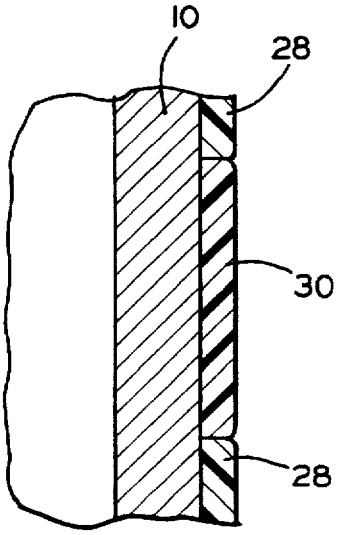

Preferably, the coating 28 of the first wax is removed in the localized area in which the second wax is to be applied. If the coating 28 of the first wax is not removed, it could melt when exposed to high temperature and adversely affect the effectiveness of the second wax. The removal of the coating 28 of the first wax can be accomplished by any suitable method, such as by scraping or dissolving it from the vehicle frame structure 10. Preferably, however, the second wax is applied in such a manner as to simultaneously remove the coating 28 of the first wax and replace it with a coating 30 of the second wax. For example, the second wax is may be applied to the localized area 19 of the vehicle frame structure 10 by spraying. As shown in FIG. 4, a hot stream 34 of the second wax is sprayed on the localized area 19 of the vehicle frame structure 10 through a dispensing nozzle 36. The second wax is sprayed in a manner which removes the coating 28 of the first wax, thereby replacing it with a coating 32 of the second wax. Thus, after the spraying is completed, the vehicle frame structure 10 will be generally covered by the coating 28 of the first wax, but have a coating 30 of the second wax only in the localized area 19 of the vehicle frame structure 10, as shown in FIG. 5.

The removal of the coating 28 of the first wax and the application of the coating 30 of the second wax are dependent on various factors in the spraying process, including the pressure at the outlet of the nozzle 36, the temperature of the stream 34, the angle X (see FIG. 4) at which the stream is oriented relative to the frame 10, the distance from the outlet of nozzle 36 to the frame 10, the diameter of the opening of the nozzle 36, and the cross-sectional shape of the envelope of the stream 34. The coating 30 of the second wax can be sprayed on the localized area 19 of the vehicle frame structure 10 using a conventional spraying apparatus, such as by an airless spraying system. One spraying system which has been found to be suitable is commercially available under the designation THERM-O-FLOW®550 hot melt dispensing system from Graco Inc. of Plymouth, Mich. It has been found that spraying the second wax from the outlet of the nozzle 36 at a pressure which is within the range of from about 1,200 psi to about 1,800 psi (8,274 kPa to about 12,411 kPa) is sufficient to remove the coating 28 of the first wax and apply the coating 30 of the second wax. Preferably, the stream 34 of the second wax exiting the nozzle 36 is directed at an angle X within the range of from about fifteen degrees to about forty-five degrees relative to the vehicle frame structure 10. The distance from the nozzle 36 to the surface of the vehicle frame structure is preferably within the range of from about six inches to about thirteen inches. Preferably, heat is maintained on the vehicle frame structure 10 during the spraying process. The stream 34 of the second wax is also preferably heated to a selected temperature during the application process. It has been found desirable to maintain the temperature of the vehicle frame structure 10 at approximately 220° F. (104° C.), and further to heat the stream 34 of the second wax to a temperature within the range of from about 400° F. to about 420° F. (204° C. to about 216° C.), for the above-mentioned waxes. Of course, the required temperatures will be dependent on the specific type of wax material used for the coatings. By regulating the temperature of the vehicle frame structure 10 and the stream 34 of the second wax, various properties, such as adhesion and the thickness of the coating 30 of second wax, can be controlled. Generally, higher temperatures of the frame 10 will produce thinner layers of the coating 30 of the second wax. In the preferred method, the first wax is applied at a first temperature and the second wax is applied at a second temperature, wherein the difference between the first and second temperatures is preferably within the range of from about 80° F. to about 185° F. (27° C. to about 85° C.).

The last step in the process is to remove the heat from the vehicle frame structure 10 and cool it to ambient temperature, as indicated by step 38 in FIG. 2. This can be accomplished by simply removing the vehicle frame structure 10 from the furnace and allowing it to cool. After being cooled, the coatings 28 and 30 harden (see FIG. 5) to provide the vehicle frame structure 10 with a relatively durable and corrosion resistant wax coating which, at the selected localized areas 19, is capable of withstanding relatively high temperatures.

As discussed above, the preferred method of removing the coating 28 of the first wax is to apply the coating 30 of the second wax in such a manner that the first coating 28 is automatically removed. However, this invention contemplates that the coating 28 of the first wax may be removed by other means. Referring to FIG. 6, there is illustrated a flow diagram of a second method of applying a coating of a corrosion resistant material to the vehicle frame structure 10 in accordance with this invention. As shown therein, a mask is initially applied to the localized areas 19 of the vehicle frame structure 10, as indicated by step 40 in FIG. 6. Any suitable masks or coverings can be used, such as shields, tape, or waxes having relatively high melting points. The masked vehicle frame structure 10 is then dipped into and removed from the hot bath of first wax, as indicated by steps 42 and 44, respectively. These steps are identical to the steps 22 and 24 in the first method illustrated in FIG. 2. The masks are then removed from the vehicle frame structure 10, as indicated by step 46 in FIG. 6, thereby exposing the surface of the localized areas 19. For example, if an adhesive masking tape is used, the tape can be simply removed from the vehicle frame structure 10 by pulling it off. If other masking materials, such as waxes are used, they can be removed by scraping, dissolving, or other suitable method. Once the masks are removed, the coating 30 of the second wax is applied to the exposed selected portions of the frame 10, as indicated by step 48. The second wax can be applied by any suitable method, such as by spraying or dipping.

FIG. 7 is a flow diagram which illustrates a third method of applying a coating of a corrosion resistant material to the vehicle frame structure 10 in accordance with this invention. As shown therein, the coating 30 of the second wax is initially applied to the localized areas 19 of the vehicle frame structure 10, as indicated by step 50 in FIG. 7. The vehicle frame structure 10 is then dipped into the bath of the first wax, as indicated by step 52. The first wax is maintained at a temperature which is less than the melting point of the second wax. As a result, the second wax will not melt off of the vehicle frame structure 10 when it is exposed to the heat from the bath of first wax. The vehicle frame structure 10 is then removed from the bath of first wax, as indicated by step 54.

In accordance with the provisions of the patent statutes, the principle and mode of operation of this invention have been explained and illustrated in its preferred embodiments. However, it must be understood that this invention may be practiced otherwise than as specifically explained and illustrated without departing from its spirit or scope. For example, although the methods of this invention have been described and illustrated with respect to the coating of the entire vehicle frame structure 10, such methods may be used to coat only a portion of the vehicle frame structure 10 or any of the individual components thereof, such as the side rails 12 and 14, the cross members 16, and the cradle 17.

What is claimed is:

1. A method of applying a coating of a corrosion resistant material to a member comprising the steps of:

(a) applying a coating of a first corrosion resistant material to first and second portions of the member;

(b) applying a coating of a second corrosion resistant material different from the first corrosion resistant material to the second portion of the member in such a manner that the coating of the first corrosion resistant material is removed from the second portion of the member.

2. The method defined in claim 1 wherein the first corrosion resistant material has a first melting temperature and the second corrosion resistant material has a second melting temperature which is higher than the first melting temperature.

3. The method defined in claim 1 wherein the first corrosion resistant material is removed from the second portion of the member by spraying the second corrosion resistant material at the second portion of the member.

4. The method deemed in claim 3 wherein the second corrosion resistant material is sprayed in a stream from a nozzle directed at the second portion of the member at an angle which is within the range of from about fifteen degrees to about forty-five degrees from a plane defined by the surface of the second portion of the member.

5. The method defined in claim 3 wherein the second corrosion resistant material is sprayed in a stream from a nozzle directed at the second portion of the member at a pressure which is within the range of from about 1,200 psi to about 1,800 psi (8,274 kPa to about 12,411 kPa).

6. The method defined in claim 1 wherein said step (a) is performed by dipping the member in a molten bath of the first corrosion resistant material.

7. The method defined in claim 1 wherein said step (a) is performed by applying the coating of the first corrosion resistant material at a first temperature and said step (b) is performed by applying the coating of the second corrosion resistant material at a second temperature, wherein the difference between the first and second temperatures is within the range of from about 80° F. to about 185° F. (27° C. to about 85° C.).

8. The method defined in claim 1 wherein the first corrosion resistant material is a wax material.

9. The method defined in claim 1 wherein the second corrosion resistant material is a wax material.

10. The method defined in claim 1 further including the initial step of pre-heating the member to a predetermined temperature prior to the application of the first corrosion resistant material.

11. A method of forming a vehicle frame assembly comprising the steps of:

(a) providing a plurality of vehicle frame members;

(b) assembling the plurality of vehicle frame members together to form a vehicle frame structure;

(c) applying a coating of a first corrosion resistant material to first and second portions portion of the vehicle frame structure; and (d) applying a coating of a second corrosion resistant material different from the first corrosion resistant material to the second portion of the vehicle frame structure in such a manner that the coating of the first corrosion resistant material is removed from the second portion of the member.

12. The method defined in claim 11 wherein the first corrosion resistant material has a first melting temperature and the second corrosion resistant material has a second melting temperature which is higher than the first melting temperature.

13. The method defined in claim 11 wherein the first corrosion resistant material is removed from the second portion of the member by spraying the second corrosion resistant at the second portion of the vehicle frame structure.

14. The method defined in claim 13 wherein the second corrosion resistant material is sprayed in a stream from a nozzle directed at the second portion of the vehicle frame structure at an angle which is within the range of from about fifteen degrees to about forty-five degrees from a plane defined by the surface of the second portion of the vehicle frame structure.

15. The method defined in claim 13 wherein the second corrosion resistant material is sprayed in a stream from a nozzle directed at the second portion of the vehicle frame structure at a pressure which is within the range of from about 1,200 psi to about 1,800 psi (8,274 kPa to about 12,411 kPa).

16. The method deemed in claim 11 wherein said step (c) is performed by dipping the vehicle frame structure in a molten bath of the first corrosion resistant material.

17. The method defined in claim 11 wherein said step (c) is performed by applying the coating of the first corrosion resistant material at a first temperature and said step (d) is performed by applying the coating of the second corrosion resistant material at a second temperature, wherein the difference between the first and second temperatures is within the range of from about 80° F. to about 185° F. (27° C. to about 85° C.).

18. The method defined in claim 11 wherein the first corrosion resistant material is a wax material.

19. The method defined in claim 11 wherein the second corrosion resistant material is a wax material.

20. The method defined in claim 11 further including the step of pre-heating the vehicle frame structure to a predetermined temperature prior to step (c).

* * * * *